US005141143A

United States Patent [19]

Ebner et al.

[11] Patent Number: 5,141,143

[45] Date of Patent: Aug. 25, 1992

[54] SHEET-STAPLING DEVICE

[75] Inventors: Arno Ebner, Ammerbuch; Helmut Ettischer, Ostfildern, both of Fed. Rep. of Germany

[73] Assignee: Eastman Kodak Company, Rochester, N.Y.

[21] Appl. No.: 670,856

[22] Filed: Mar. 18, 1991

[30] Foreign Application Priority Data

Jun. 27, 1990 [DE] Fed. Rep. of Germany ..... 4020355

[51] Int. Cl.[5] ..... B27F 7/19; B27F 7/36

[52] U.S. Cl. ..... 227/129; 227/131; 227/154

[58] Field of Search ..... 227/129, 131, 152, 153, 227/154, 155; 173/123

[56] References Cited

U.S. PATENT DOCUMENTS 2,914,768 12/1959 Flood ..... 227/153
4,344,554 8/1982 Cross ..... 277/153
4,557,410 12/1985 Holden et al. ..... 227/155

*Primary Examiner*—Douglas D. Watts

*Assistant Examiner*—Rinaldi Rada

*Attorney, Agent, or Firm*—Tallam I. Nguti

[57] ABSTRACT

A cam unit (3) with cams (3*a*, 3*b* and 3*c*) is mounted by journals (3*d*) directly on plastic housing portions (1 and 2). A bracket (5) which is actuated by cam (3*a*) is slidably arranged on one housing portion (2) together with a back-up (26) and a clincher unit (9, 10). A slider (8) shiftably mounted on bracket (5) actuates the clincher unit (9, 10) via a cam (3*c*). Another cam (3*b*) engages a sliding block (6) which operates a stapler (15 to 17). The entire stapling device is slidable along a driven profiled shaft (4) positively coupled with cam unit (3). The cams (3*a*, 3*b*, 3*c*) are designed such that, in relation to the journals (3*d*), two diametrically opposed force-transmitting cam sections of different cams (3*a* and 3*b* and 3*c*, respectively) each become effective at a time. Thus, a force of action in one direction, which is caused by one cam (3*b* and 3*c*, respectively), is counteracted by a force of reaction of equal strength in the other direction, which is caused by the other cam (3*a* and 3*b*, respectively). As a result, the bearing load on the journals (3*d*) is kept low throughout the stapling operation.

9 Claims, 6 Drawing Sheets

SHEET-STAPLING DEVICE

BACKGROUND OF THE INVENTION

1. Field of the Invention

The present invention relates to a device for stapling sheets arranged in stacks, which comprises a driver unit for driving the staples from one side and a clincher unit for folding over the staple ends from the other side, both units being actuated by a rotary control member, and which also comprises a slider that connects the clincher unit with a cam of the control member.

2. Description Relative to the Prior Art

U S. Pat. No. 4,557,410 discloses a device of this type wherein the staples are driven by a rotating cam disk to which a bellcrank hinged to the driver unit is eccentrically mounted. The back-up for the sheets to be stapled is stationarily arranged in the housing. In the case of this known device, a force of varying strength is required for the driving operation, which must be greatest in the most unfavorable position of the crank pin on the side of the cam disk, i.e. at the point when the staple penetrates the sheets. This causes a bearing load, which is one-sided and which varies, on the cam disk and on the crank pins. Apart from the fact that the bellcrank with its crank pins requires additional control and increases noise, the bearing sites of such parts, and in particular, the bearing means of the cam disk have to be stable enough to withstand the high one-sided bearing pressures which are, moreover variable Such a device cannot, therefore, be manufactured from inexpensive materials.

SUMMARY OF THE INVENTION

It is the object of the present invention to design a device of the generic type such that at all stages of the stapling operation a drive is attained which combines a maximum of stability with a minimum of noise while also keeping the bearing load consistently low.

According to the present invention, this object is attained in that:

- the control member is a cam unit arranged on, and driven by, a driving shaft;
- a bracket is provided which is guided for reciprocating movement in the stapling direction, a first arm of the bracket extends over the area of the sheet stack that is to be stapled and forms both the back-up for the driver unit and the bearing for the clincher unit, and a second arm of the bracket engages a first cam of the cam unit;
- a second cam actuates the driver unit;
- a third cam engages the slider of the clincher unit; and
- in relation to the axis of rotation of the driving shaft, the cams are configured and arranged such that two diametrically opposed cam sections each of different cams are simultaneously brought into engagement such that a force of action in one direction, which is caused by one cam, is counteracted by a force of reaction of equal strength in the opposite direction, which is caused by the other cam.

According to an advantageous modification of the present invention, the center of rotation of the driving shaft and the power-delivering cam sections of the cams are arranged substantially on a common line of action with the driver unit and the clincher unit.

According to another advantageous modification of the invention, the driver unit is actuated by a cam taking the form of an arcuate triangle and arranged in a shiftable sliding block which is positively mounted and slidably guided at the junction of two housing portions, thereby facilitating manufacture and assembly.

Advantageously, the cam unit is mounted directly on the housing portions on which all components of the stapling device are arranged as well so that the stapling device can be mounted as an integral assembly unit, and so can be easily moved into various stapling positions.

In a particularly useful manner, the cam unit is mounted for sliding movement along the driving shaft, which is a profiled shaft, and is permanently held in positive engagement with said shaft so that the stapling device is advantageously immediately ready for use in each stapling position into which it is moved.

Since the stapling device according to the present invention is designed such that forces are simultaneously directed against each other, the bearing points of the cam unit are subjected to a minimum load, which keeps bearing friction low. As a result, the driving power required for operating the stapling device may be consistently lower since even in the case of increasing demands—driving the staple into the stack—no loss of performance need be compensated by increased bearing friction.

The low forces acting on the bearings reduce wear and tear at the bearing sites and diminish the danger of distortion so that, advantageously, a plastic housing that can be produced at low cost is usable to directly support the cam unit and all the other functional components of the stapling device. Therefore, all other functional components of the stapling device can be manufactured, in a cost-saving manner, chiefly from plastic.

Friction and distortion are moreover minimized in that the cam sections of the cams effective at a time are arranged in a common line of action with the driver unit and the clincher unit whereby tilting moments are minimized.

All in all, the design of the stapling device according to the present invention improves the functional uniformity, and thus the smoothness of operation of the stapling device.

BRIEF DESCRIPTION OF THE DRAWINGS

Further features and advantages can be inferred from an embodiment of the invention illustrated in the drawings and from the subclaims.

The drawings show schematically in

BEST MODE FOR CARRYING OUT THE INVENTION

The stapling device according to the present invention is arranged on a known type of finishing device (not illustrated) wherein individually supplied sheets, in particular copy sheets dispensed by a copier, are collected in stacks in a collecting station and are then combined in sets by means of staples.

Figure 5:
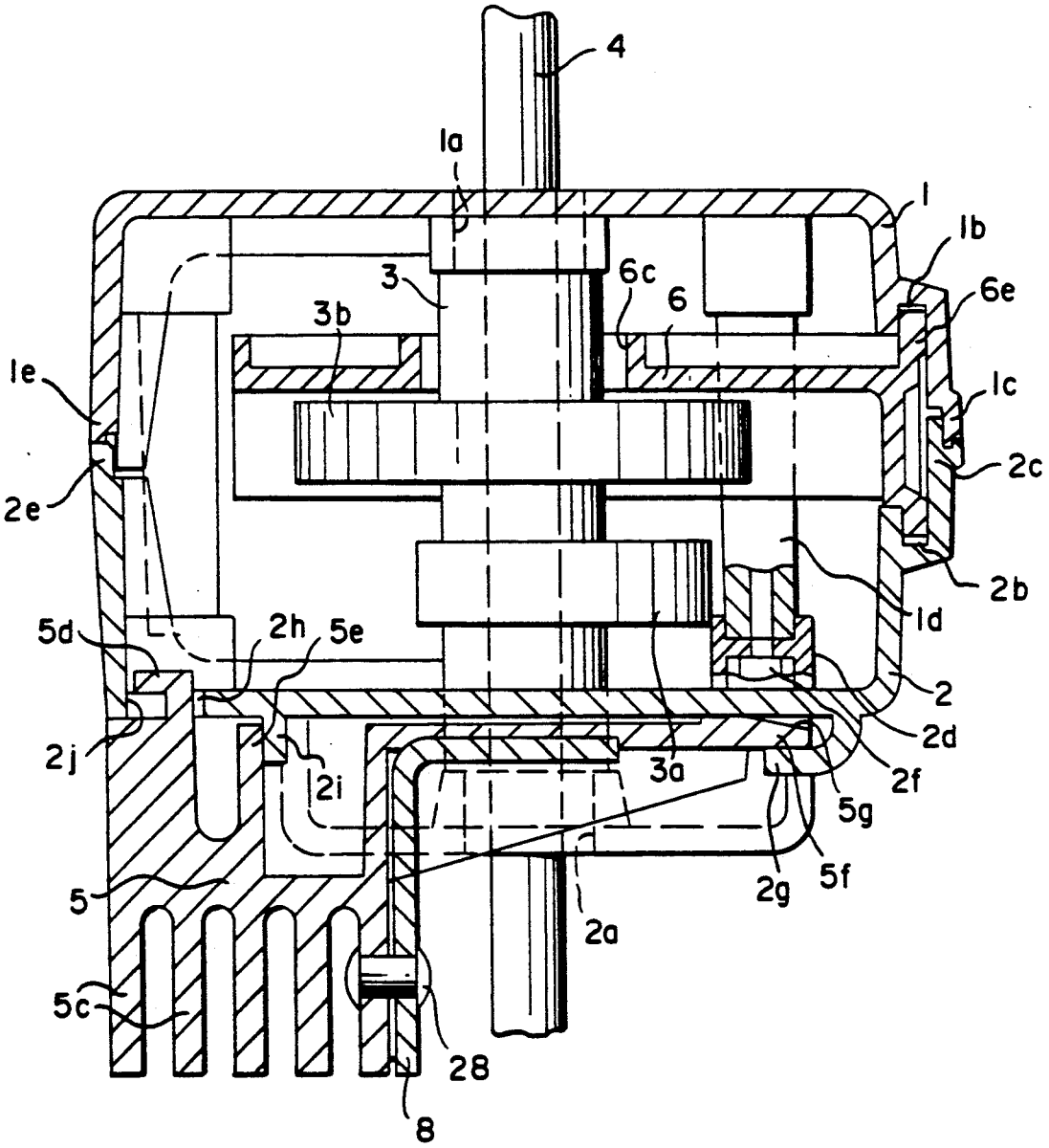
FIG. 5 a section taken along line A—A in FIG. 4.

The stapling device is mounted as an integral assembly unit in or on two cup-shaped plastic housing portions 1 and 2 whose marginal sections 1*c*, 1*e* and 2*c*, 2*e* are held in positive engagement as illustrated in FIG. 5. The housing portions 1, 2 are held in frictional engagement by neck screws (not shown) which are inserted from the side of housing portion 1 into support legs 1*d* provided with bores. The neck screws are screwed into hexagonal nuts (not illustrated) which are held by positive engagement in corresponding recesses 2*f* of the other housing portion 2. The recesses 2*f* are located in back-ups 2*d* which are molded to housing portion 2 and, pointing inwards, serve with their sections facing the support legs 1*d* to position and support said legs. A plurality of such screw connections are provided so that the housing portions 1 and 2 along with the positively engaged marginal areas 1*c*, 1*e* and 2*c*, 2*e*, respectively, insure both easy assembly and a precise and dimensionally stable fastening.

Molded to housing portions 1 and 2 are two bearings 1*a* and 2*a*, respectively, which are aligned with each other and in which journals 3*d* of a cam unit 3 are directly mounted for rotation.

The cam unit 3 is made from plastic and is slidable along a driven shaft 4 having a hexagonal cross-section and being mounted in the device. Cam unit 3 is designed such that it is in positive rotary engagement with said shaft 4. Cam unit 3 comprises cams 3*a*, 3*b* and 3*c* which are molded to it and whose functions and association will be described below.

A first cam 3*b* shaped like an arcuate triangle is arranged between two jaws 6*a*, 6*b* of a cup-shaped sliding block 6 which is made from plastic and is slidable in the stapling direction "B". Sliding block 6 includes a guide flange 6*e* slidably guided in oppositely arranged guide grooves 1*b*, 2*b* of the housing portions 1 and 2. Sliding block 6 is provided with a recess 6*c* through which cam unit 3 extends and which is disposed longitudinally in the direction of the arrow "B" so that sliding block 6 can be shifted.

The upper face of the upper jaw 6*a* of sliding block 6 actuates a commercially available stapler head 14, 15 of a type known per se which is not illustrated in detail. It serves to bend and drive in wire sections which are combined to form a strip and fed to stapler head 14, 15 from a cassette 23. Stapler head 14, 15 and the cassette, which is also commercially available, are mounted to housing 1,2 in a manner not illustrated, cassette 23 being exchangeable.

Stapler head 14 has a slidable stapler 15 at the lower end of which a plunger 17 is slidably guided, said plunger influencing a pressure spring 16. Plunger 17 is guided in a pin-and-slot arrangement 18, 24 and secured against rotation by engagement of pin 18 in a recess 25 of stapler 15. A leaf spring 19 secured to sliding block 6 and serving for frictionally withdrawing stapler 15 through sliding block 6 into its initial position extends across pin 18.

Moreover, an entrainment arm 6*d* (see FIGS. 1 to 3) is molded to sliding block 6. It overlaps a step of stapler head 15 and by positive engagement returns it after a short travel to its initial position if increased friction prevents stapler 15 from being returned by frictional engagement.

A second cam 3*a* of cam unit 3 takes the form of a concentric sector whose cam surface engages the lower arm 5*b* of a bracket 5.

Bracket 5 is arranged on the outer side of second housing portion 2 and guided from sliding movement in the stapling direction "B". An upper arm 5*a* of bracket 5 extends across the area where a staple is to be applied to a sheet stack 7 located in a collecting station 20 of the device. The back-up 26 associated with stapler head 14, 15 is arranged on the upper arm 5*a* of bracket 5 (see FIG. 4) and carries two pivotable jaws 10 of a type known per se which can be actuated by a bolt 9 and serve to fold over and fix the ends of the staple which extends through sheet stack 7.

Bracket 5, which is also made from plastic, comprises on its outer side reinforcing ribs 5*c* (see FIG. 5) which extend along the whole length of bracket 5 and its arms 5*a*, 5*b*. The means for longitudinal guiding of bracket 5 on housing portion 2 can be seen in FIG. 5; they consist of two L-shaped projections 5*d*, which project through longitudinal slots 2*h*, and of a guide rib 5*e*, which rests against a web portion 2*i* of housing portion 2. Bracket 5 is held on the one hand by the L-shaped projections 5*d*, which engage around the wall of housing portion 2, and on the other hand by an arm 5*f*, which is held and guided between an overlapping wall 2*g* and the other surface of housing portion 2.

Arm 5*f* has an inclined section 5*g* which faces housing portion 2 and serves to mount bracket 5 thereon. For that purpose, bracket 5 is shifted below the overlapping wall 2*g* in an angular position such that the inclined section 5*g* is about parallel with the outer surface of housing portion 2. When the portion of bracket 5 which features the L-shaped projections 5*d* is pivoted into position, said projections pass through widened sections 2*j* (see FIGS. 4 and 5) of the longitudinal slots 2*h* into the interior of housing portion 2. When bracket 5 is shifted in the longitudinal direction, the L-shaped projections 5*d* move into the narrower longitudinal slots 2*h* where they are locked behind housing portion 2 so that the bracket is held by positive engagement and with its arm 5*f* is guided with great precision on a broad base and prevented from tilting.

A third cam 3*c* molded to cam unit 3 is associated with a slider 8 (see FIGS. 4 and 5) preferably made from metal and slidably guided on bracket 5 by means of journals 27, 28 and guide slots 29, 30. Slider 8 is engaged by a tension spring 13 hooked to a hook-shaped projection 2*k* of housing portion 2 and pulling slider 8 into an upper initial position defined by the guide slots 29, 30. Slider 8 itself pulls bracket 5, via tension spring 13, into an upper end position which is defined by abutment of its lower arm 5*b* against cam 3*a*. Slider 8 has a lower arm 8*a* supporting a rotary roller 31 which is engaged by the third cam 3*c*. An upper arm 8*b* of slider 8 extends over the upper arm 5*a* of bracket 5 and actuates it via the upwardly projecting bolt 9 which projects from the upper surface of said arm.

The total stapling device mounted to the housing portions 1 and 2 is movable along the profiled shaft 4 and guided for sliding movement on guide rods 11 and 12 of the device by means of guide bearings 1*f*, 1*g* and 21, respectively, of the housing portions 1 and 2. The stapling device is movable along such guide means by a drive (not shown) to assume a number of different stapling positions and is immediately ready to function in each of such positions thanks to its permanent positive engagement with the profiled shaft 4.

Figure 1:
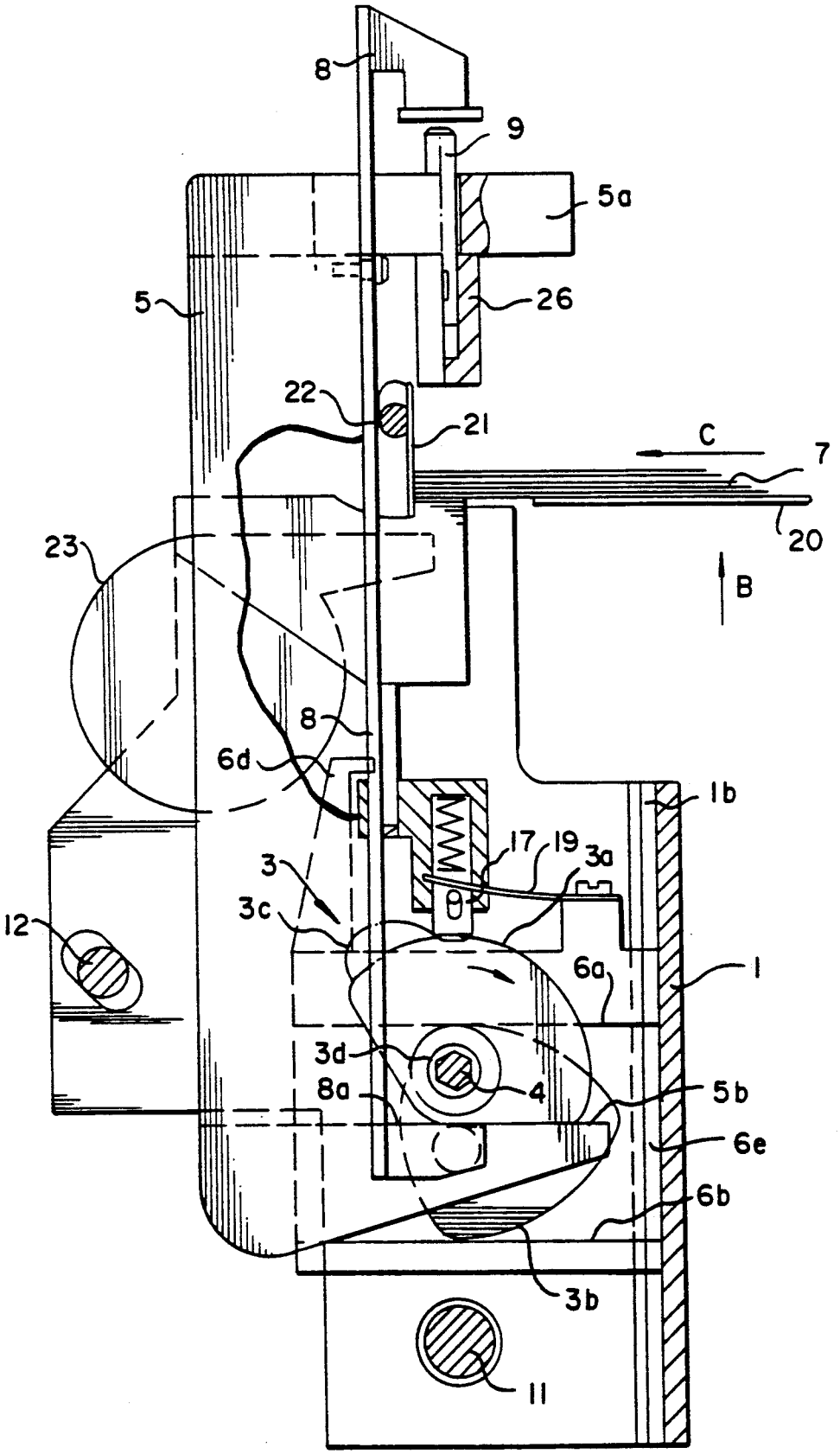
FIG. 1 a lateral view, partially in section, of the device in its initial position.

The device functions as follows:

FIG. 1 shows the device in its initial position in which back-up 26 is lifted from the collecting station 20 far enough to allow the incoming sheets to move freely up to an abutment 21 which is pivotable by means (not shown) in a clockwise direction for example about a journal 22 as is well known in the art in order to move it out of the way of the sheet stack 7 being moved in the direction of the arrow "C".

As soon as the number of sheets to be stapled has been collected, profiled shaft 4 is set in rotary motion by a drive (not illustrated) so that cam unit 3 rotates clockwise, the second cam 3*a* urging, via lower arm 5*b*, bracket 5 downwards in opposition to the direction of the arrow "B" and moving back-up 26 towards sheet stack 7, without direct contact being made.

Figure 2:
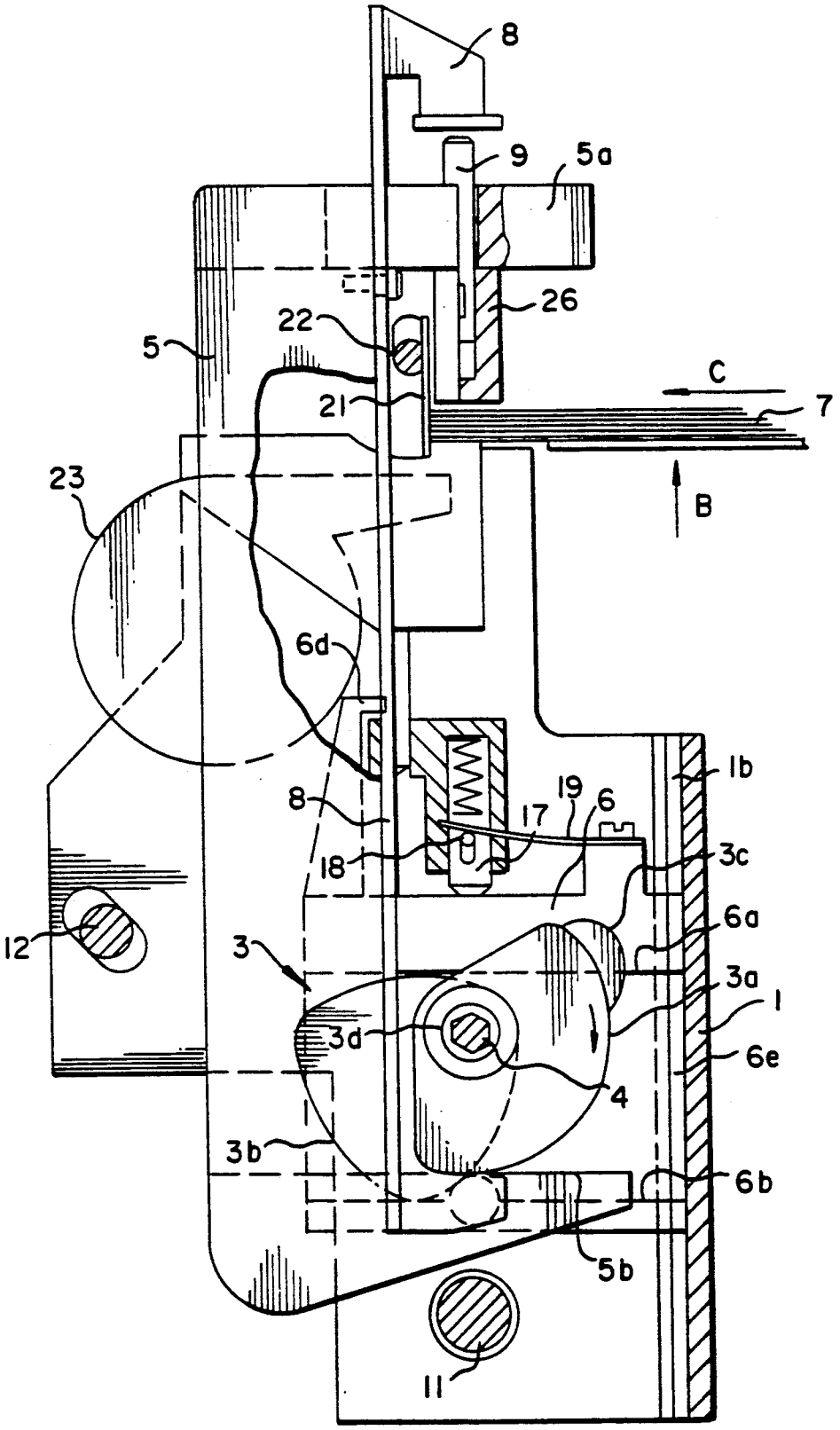
FIG. 2 the device according to FIG. 1 at the beginning of the driving operation.

During such first partial rotation of cam unit 3 from the position shown in FIG. 1 to that shown in FIG. 2, the concentric section of the first cam 3*b* acts on the lower jaw 6*b* of sliding block 6 so that said block is arrested. While bracket 6, along with back-up 26 is being lowered, no substantial forces become effective at the journals 3*e* of cam unit 3 because only tension spring 13 is tensioned.

When the position shown in FIG. 2 is reached, the concentric sector of second cam 3*a* becomes effective so that bracket 5 remains in the lower position which it has reached. However, the ascending cam section of first cam 3*b* becomes effective by which sliding block 6 is shifted upwards. Sliding block 6 first moves towards plunger 17 and then pushes it upwards in the direction of arrow "B". Plunger 17 counteracts the strong bias of pressure spring 16 and, without compressing said spring. moves stapler 15 in the direction of the arrow "B". During such movement of stapler 15 a wire section of the wire strip is bent to form a staple, separated from the strip and driven into sheet stack 7 from below, with sheet stack 7 resting against upper back-up 26.

Figure 6:
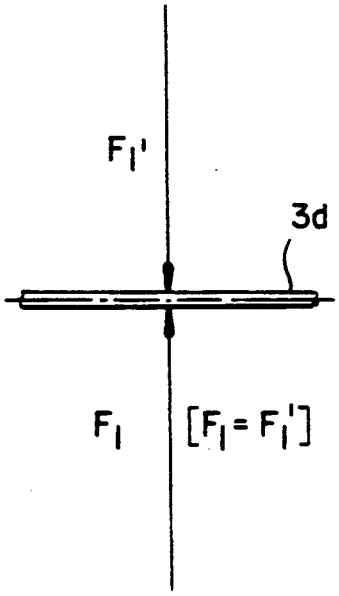
FIG. 6 a diagram with arrows indicating the distribution of forces in the stapling phase according to FIG. 1.

During driving in of the staple, the upwardly directed force of action F1, which is caused by first cam 3*b*, is counteracted by a downwardly directed force of reaction F1 of equal strength which is caused by second cam 3*a*. This balance of forces, which is illustrated in FIG. 6, minimizes the stress to which the bearings 1*a* and 2*a* are subjected by the journals 3*d* of cam unit 3.

The low bearing load thus achieved during the whole stapling operation, which will be explained in more detail below, allows the journals 3*d* of cam unit 3 to be mounted directly on the molded bearings 1*a*, 2*a* of the plastic housing portions 1 and 2. Additional bushings are not required nor need the housing portions 1 and 2 be made from any special and expensive material.

After the staple has been driven through sheet stack 7, stapler 15 is moved further upwards in the direction of arrow "B" by the ascending cam section of cam 3*b*. When stapler 15 comes to rest against sheet stack 7, which is pressed against upper back-up 26, pressure spring 16 is compressed, which compensates for variations in the thickness of the sheet stack.

Figure 7:
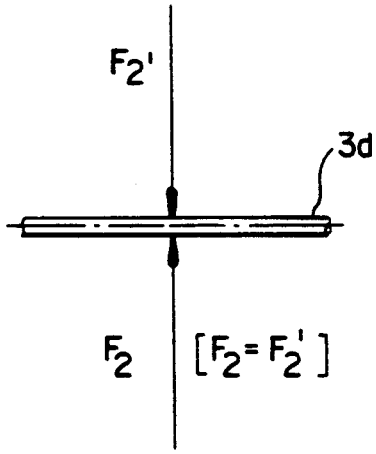
FIG. 7 a diagram with arrows indicating the distribution of forces in the stapling phase according to FIGS. 2.

In this phase of operation, the upwardly directed force of action $F_2$ (pressure spring 16 is tensioned) is counteracted by a downwardly directed force of reaction $F_2$, of equal strength which is caused by upper back-up 26 (see FIGS. 7) so that in this phase, too, the bearing load is kept low.

Figure 3:
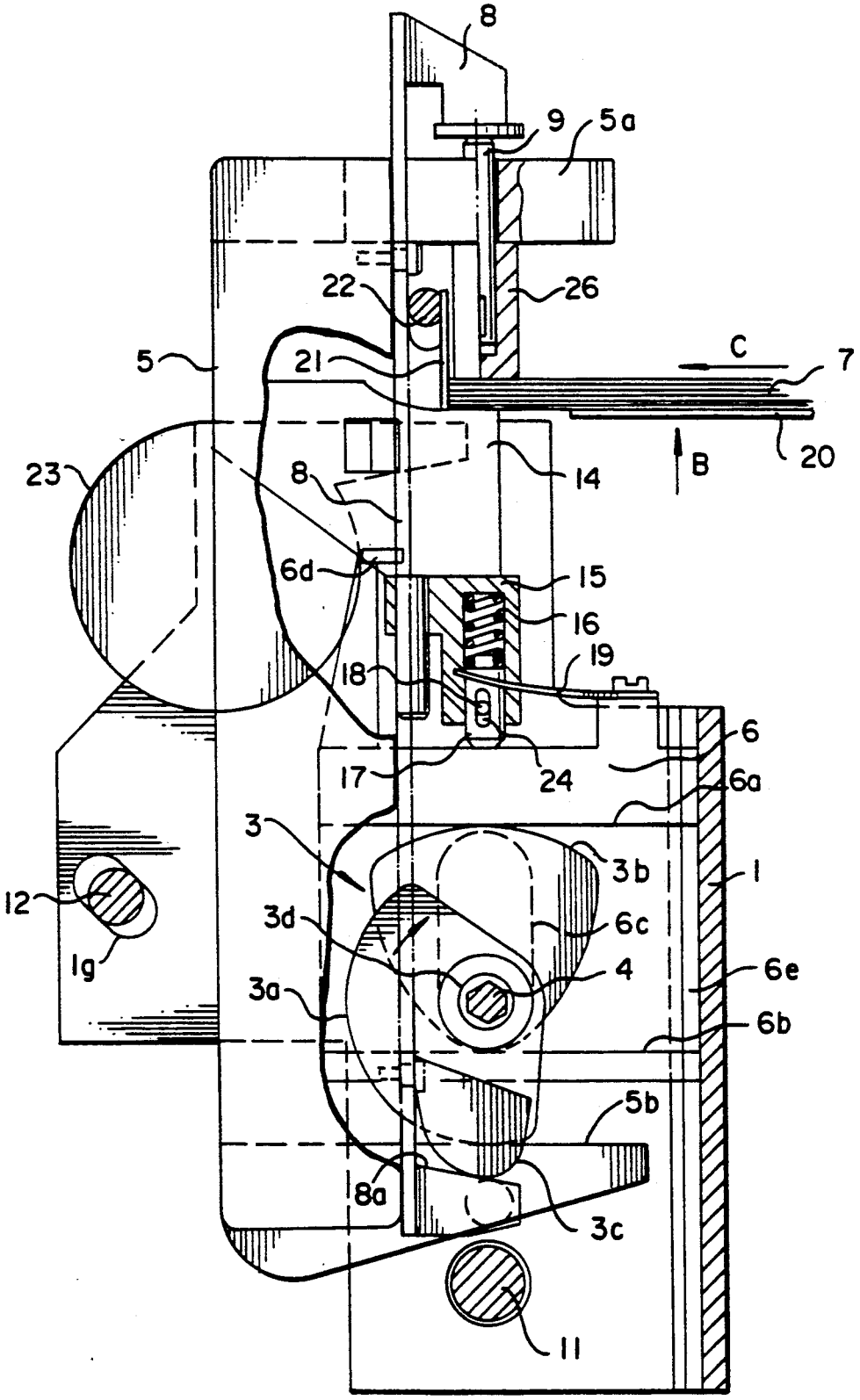
FIG. 3 the device according to FIG. 1 at the end of the stapling operation.
Figure 4:
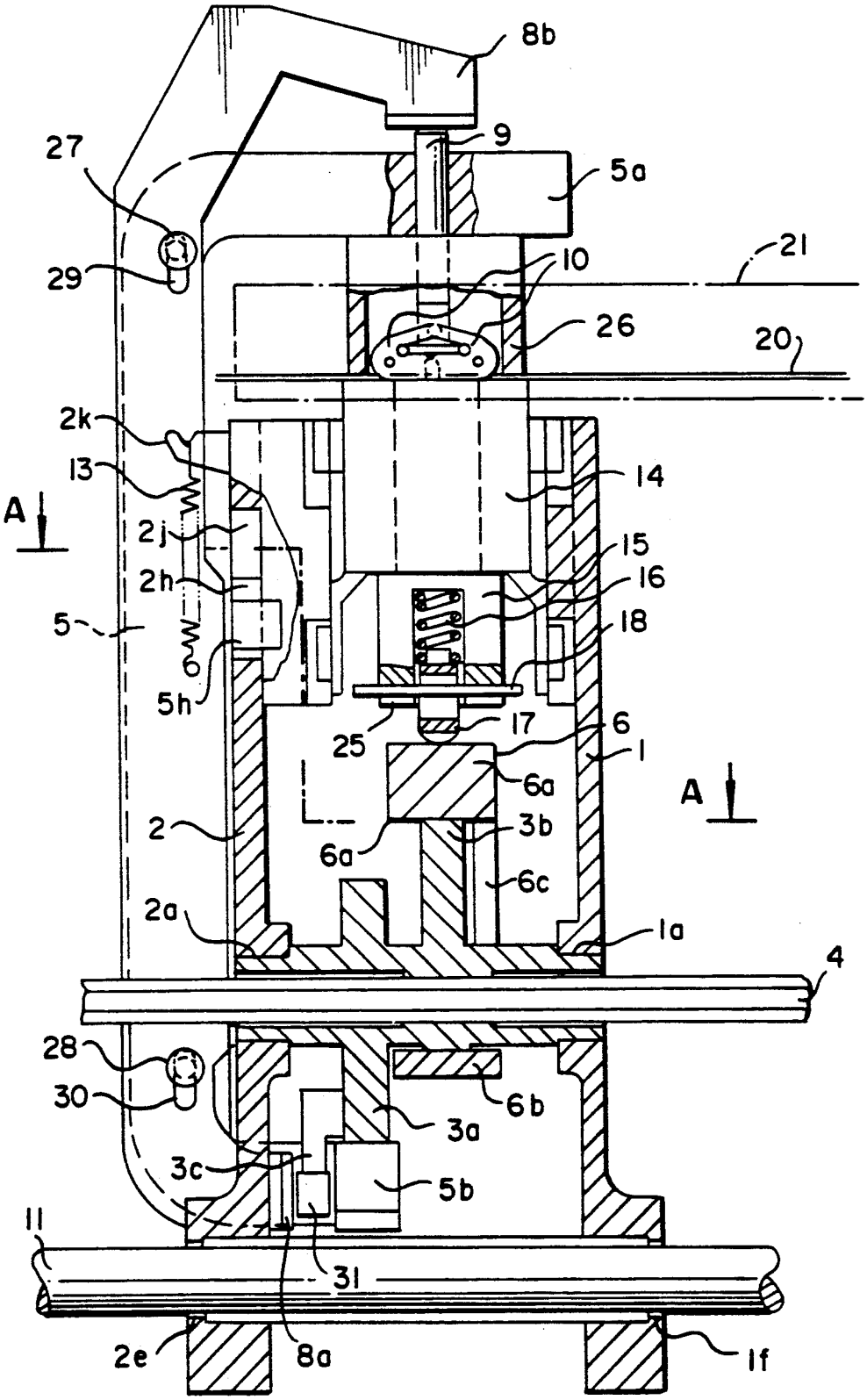
FIG. 4. a front view, partially in section, of the device according to FIG. 3.

When cam unit 3 is rotated further, see FIGS. 3 and 4, the concentric section of the first cam 3*b* contacts the upper jaw 6*a* of sliding block 6 so that said block is arrested. At the same time, the third cam 3*c* is brought into engagement with roller 31 of slider 8 and forces the slider downwards in opposition to the direction of arrow "B". This actuates bolt 9 which pivots the two jaws 10 which in a manner known per se fold the staple ends projecting upwardly from sheet stack 7 and press them into a flat position on the stack.

Figure 8:
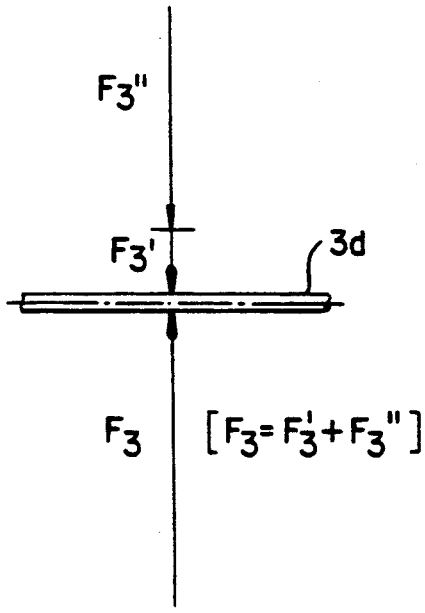
FIG. 8 a diagram with arrows indicating the distribution of forces in the stapling phase according to FIGS. 3 and 4.

During this phase of operation, too, (see FIG. 8) the upwardly directed force of action $F_3$ (stapler 15) is counteracted by a downwardly directed force of reaction of equal strength which is composed of the partial forces $F_3$, (pivotal jaws 10) and $F_3''$ (slider 8, 8*b*). Hence, as shown, the bearing load is also low in this phase.

As clearly illustrated in FIGS. 1 to 3, the areas of contact of the cams 3*a*, 3*b* and 3*c* with, respectively, sliding block 6, lower arm of bracket 5 and roller 31 of slider 8 are located substantially on a common line of action of the forces generated, said line being formed by the axis of rotation of cam unit 3, plunger 17 with stapler 15 and jaws 10 with bolt 9. This advantageously excludes tilting moments which might increase the bearing load and cause distortion of the housing 1, 2. Moreover, the absence of distortion in the stapling device allows the sliding block 6 to be unilaterally guided on a guide flange 6*e* so that free space is made available for the arrangement of support legs 1*d* for screwing together of the housing portions 1, 2 in the inner space of said portions opposite to said flange.

Tilting moments can also be minimized in that—starting from the illustration in FIG. 4—a further pair of cams 3*a*, 3*c* (not illustrated) is arranged symmetrically with cam 3*b*. In such a case the cam follower means of the additional pair of cams would have to be adapted accordingly, for example by a forklike design of the lower arm 5*b* and 8*a*, respectively.

At the end of the stapling operation, the cam unit 3 continues to rotate clockwise. During such movement, the concentric section of the first cam 3*b* leaves the upper jaw 6*a* so that sliding block 6 is moved downwards by the ascending cam section of cam 3*b* which acts on the lower jaw 6*b* of sliding block 6. During this return movement of sliding block 6, pressure spring 16 is first released and stapler 16 retracted by means of leaf spring 19. Should frictional engagement of stapler 15 be prevented by increased friction (caused by soiling, wear and tear and the like) arm 6*d* of sliding block 6 would engage stapler 15, after a short initial travel, and entrain it by positive engagement.

Simultaneously with the return of stapler 15 into its lower initial position, cams 3*a* and 3*b* also change their positions to disengage bracket 5 and slider 8 which, under the influence of tension spring 13, are returned to their upper raised initial positions. When the initial position as shown in FIG. 1 has been reached, the stapling device is arrested.

After abutment 21 has been pivoted about journal 22 the stapled sheet stack 7 is transported by means not illustrated in the direction of the arrow "C" and deposited in a tray not shown.

The invention has been described in detail with particular reference to a presently preferred embodiment, but it will be understood that variations and modifications can be effected within the spirit and scope of the invention.

We claim:

1. A stapling device for stapling sheets arranged in stacks, the stapling device comprising:

(a) a driver unit (15) for driving ends of a staple from a first side of a stack of sheets through to a second side thereof;

(b) means including a sliding block (6) for moving said driver unit in a direction for driving staples;

(c) a back-up member (26) for said driver unit, said back-up member being locatable against the second side of the stack of sheets;

(d) means including a bracket (5) for moving said back-up member against the second side of the stack of sheets;

(e) a clincher unit (9, 10) mounted on said back-up member (26) for folding ends of a staple driven through the stack of sheets;

(f) means including a slider (8) for moving said clincher unit to fold ends of a staple so driven; and (g) a rotary control means for controlling the movement of said back-up member and said driver and clincher units, said rotary control means including a driven shaft (4), and a cam assembly (3) mounted on said driven shaft for rotation therewith, said cam assembly (3) including:

(i) a first cam unit (3*b*) for applying a first force $F_1$ to said driver unit (15) for driving a staple through the stack of sheets, and for applying a second reaction force $F_3$ in reaction to forces applied on the second side of the stack of sheets for folding ends of a driven staple;

(ii) a second cam unit (3*a*) for applying a reaction force $F_1'$ to said back-up member (26) in reaction to said first force $F_1$ for driving staples, said reaction force $F_1'$ to be applied in a direction opposite to the direction of said first force $F_1$;

(iii) a third cam unit (3*c*l) for applying clinching forces $F_3'$ and $F_3''$ to said clincher unit (9, 10) for folding over ends of a driven staple, said clinching forces $F_3'$, $F_3''$ to be applied in a direction opposite to the direction of the reaction force $F_3$ of said first cam unit (3*b*l).

2. The stapling device of claim 1 wherein said reaction force $F_1'$ is equal in strength to said first, staple driving force $F_1$.

3. The stapling device of claim 1 wherein said reaction force $F_3$ is equal in strength to the sum of said clinching forces $F_3'$ and $F_3''$.

4. The stapling device of claim 1 wherein said first, second and third cam units apply their respective forces at points located on a line substantially common with the axis of rotation of said driving shaft (4).

5. The stapling device of claim 1 wherein said first cam unit (3*b*) is shaped like an arcuate triangle and is mounted for engaging said sliding block (6).

6. The stapling device of claim 5 wherein said sliding block (6) is cup-shaped and includes a flange portion (6*e*).

7. The stapling device of claim 6 including guide grooves (1*b*, 2*b*) formed in housing portions (1, 2) of the stapling device for receiving said flange portion (6*e*l) of said sliding block (6).

8. The stapling device of claim 6 wherein said sliding block (6) includes an entrainment arm (6*d*) for positively engaging said driver unit (15).

9. The stapling device of claim 6 wherein said sliding block (6) includes a driving spring (19) for engaging said driver unit (15).

* * * * *

UNITED STATES PATENT AND TRADEMARK OFFICE

CERTIFICATE OF CORRECTION

PATENT NO. : 5,141,143

DATED : August 25, 1992

INVENTOR(S) : Arno Ebner & Hemut Ettischer

It is certified that error appears in the above-indentified patent and that said Letters Patent is hereby corrected as shown below:

Column 8, claim 1, line 5, after "forces $F_3$' and " "$F_3$'" should be --$F_3$" --.

Column 8, claim 1, line 9, after "first cam unit", "(3b1)" should be --(3b) --.

Column 8, claim 7, line 28, after "said flange portion" "(6e1)" should be --(6e)--.

Signed and Sealed this

Fourteenth Day of September, 1993

Bruce Lehman

*Attest:*

BRUCE LEHMAN

*Attesting Officer*

*Commissioner of Patents and Trademarks*